United States Patent [19]

Asai et al.

[11] Patent Number: 4,514,856

[45] Date of Patent: Apr. 30, 1985

[54] APPARATUS FOR SELECTING THE PRECISE NUMBER WITHIN A BATCH OF PAPER SHEETS

[75] Inventors: Mamoru Asai, Kashiwa; Tsuneyoshi Mitani, Kawasaki; Hiroyuki Ookawa, Tokyo, all of Japan

[73] Assignee: Musashi Engineering Kabushiki Kaisha, Tokyo, Japan

[21] Appl. No.: 484,284

[22] Filed: Apr. 12, 1983

[30] Foreign Application Priority Data

Apr. 17, 1982 [JP] Japan ..... 57-64529

[51] Int. Cl.[3] ..... G06M 7/06

[52] U.S. Cl. ..... 377/8; 364/709; 355/14 CU

[58] Field of Search ..... 377/8; 364/709; 368/107–111; 355/14 CU

[56] References Cited

U.S. PATENT DOCUMENTS

| | | | |
|---|---|---|---|
| 3,891,973 | 6/1975 | Maxwell | 377/26 |
| 4,090,247 | 5/1978 | Martin | 364/709 |
| 4,250,401 | 2/1981 | Sumida | 377/26 |
| 4,255,651 | 3/1981 | Phillips | 377/26 |
| 4,374,425 | 2/1983 | Fuka | 364/709 |
| 4,398,819 | 8/1983 | Schron | 355/14 CU |

*Primary Examiner*—John S. Heyman
*Assistant Examiner*—K. Ohralik
*Attorney, Agent, or Firm*—Brooks, Haidt, Haffner & Delahunty

[57] ABSTRACT

An apparatus for counting the number of paper sheets is described in which a target number entered by an entry unit is stored in a target number memory and displayed in a target number display section, the count number supplied from a sensor and counter section since the time of start of counting is displayed in a count number display section and compared to said target number, and the counting number is discontinued in case of coincidence between said count number and the target number. According to the invention, the entry section has a batch key, a plus key and a minus key. A gross or an approximate number is entered by the batch key and incremented or decremented by the plus or minus key for adjustment of the gross number to the desired number. When the gross number is the infinite number, a continuous counting operation is performed until depletion of the paper sheets.

2 Claims, 3 Drawing Figures

APPARATUS FOR SELECTING THE PRECISE NUMBER WITHIN A BATCH OF PAPER SHEETS

BACKGROUND OF THE INVENTION

This invention relates to an apparatus for counting the number of paper sheets and so on.

The apparatus of this type is used for counting the number of banknotes, voting cards, checks or bills. In general, the methods of counting the sheets may be variable with the objective of counting. For example, the method of continuous counting may be employed when desired to grasp the total number of paper sheets in subject or to ascertain that the actual number of paper sheets is equal to the indicated value. On the other hand, the batch counting may be resorted to when the paper sheets in subject are to be arranged in bundles or batches each containing a predetermined number of the sheets.

The apparatus of this type is described for instance in our copending Japanese Laid-Open Patent Specification No. 58-6023 entitled "Apparatus for Counting the Number of Voting Cards" filed on July 3, 1981. In the method of batch counting of voting cards disclosed in said Patent Application, the number of the voting cards making up each bundle or batch and stored in the memory of the counting apparatus is entered by a knob to a desired one of a plurality of predetermined values such as 10, 20, 50, 100, 200 and infinity ($\infty$). The counting apparatus disclosed in said Patent Application is so designed and constructed that condition judgment signals or count number signals from the associated sensors are used to display the presence of defective cards or defective transfer states as the above signals are transferred through the memory, comparator or control units.

In the aforemetioned counting apparatus, the number of paper sheets once entered by the knob for the batch operation is fixed and it is impossible to enter an arbitrarily selected number other than such fixed value. Thus the apparatus is not applicable to counting the number of paper sheets in general. For entering an arbitrarily selected number, it is also known to use a ten-key board in place of the entry knob and to designate the desired number by selective actuation of the numerical keys. The number thus entered is stored in a memory and occasionally compared to the actual count number and a count terminating signal is issued when there is a coincidence between the target number and the count number. With such ten-key boards, it is impossible to reduce the overall size of the apparatus because of structural requirements. In addition, the operation of the apparatus is complicated because the same number of keys as that of the digits need be actuated each time a new target number is entered in the apparatus.

A counting apparatus is also known in which the display in the count number display unit in the magnetic counter is incremented and the display in the number entry unit operatively geared to said count number display unit is decrement with each passage of a banknote, and in which the counting operation is terminated when the preset number in the entry unit is null. With this apparatus, the operation is complicated because it is necessary to disconnect the display unit from the entry unit each time a new target number is set and to connect the two units after setting the new target number. Any error caused in the connecting and disconnecting process may lead to destruction of the counter units. In addition, with this counting apparatus, it is impossible to reduce the overall size of the apparatus or to elevate the rate of counting because of structural constraints.

SUMMARY OF THE INVENTION

In view of the foregoing, it is an object of the present invention to provide an apparatus for counting the number of paper sheets according to which three different types of keys are provided, namely a batch key, a plus key and a minus key, one of several predetermined numbers may be stored in advance by operation of the batch key, and the number thus selected is incremented or decremented by operation of the plus or minus key for ultimate adjustment to permit the desired number to be entered easily into the apparatus.

According to the present invention, a microprocessor may be used as the arithmetic operation unit for reducing the overall size of the apparatus.

DESCRIPTION OF THE PREFERRED EMBODIMENT

Figure 1:
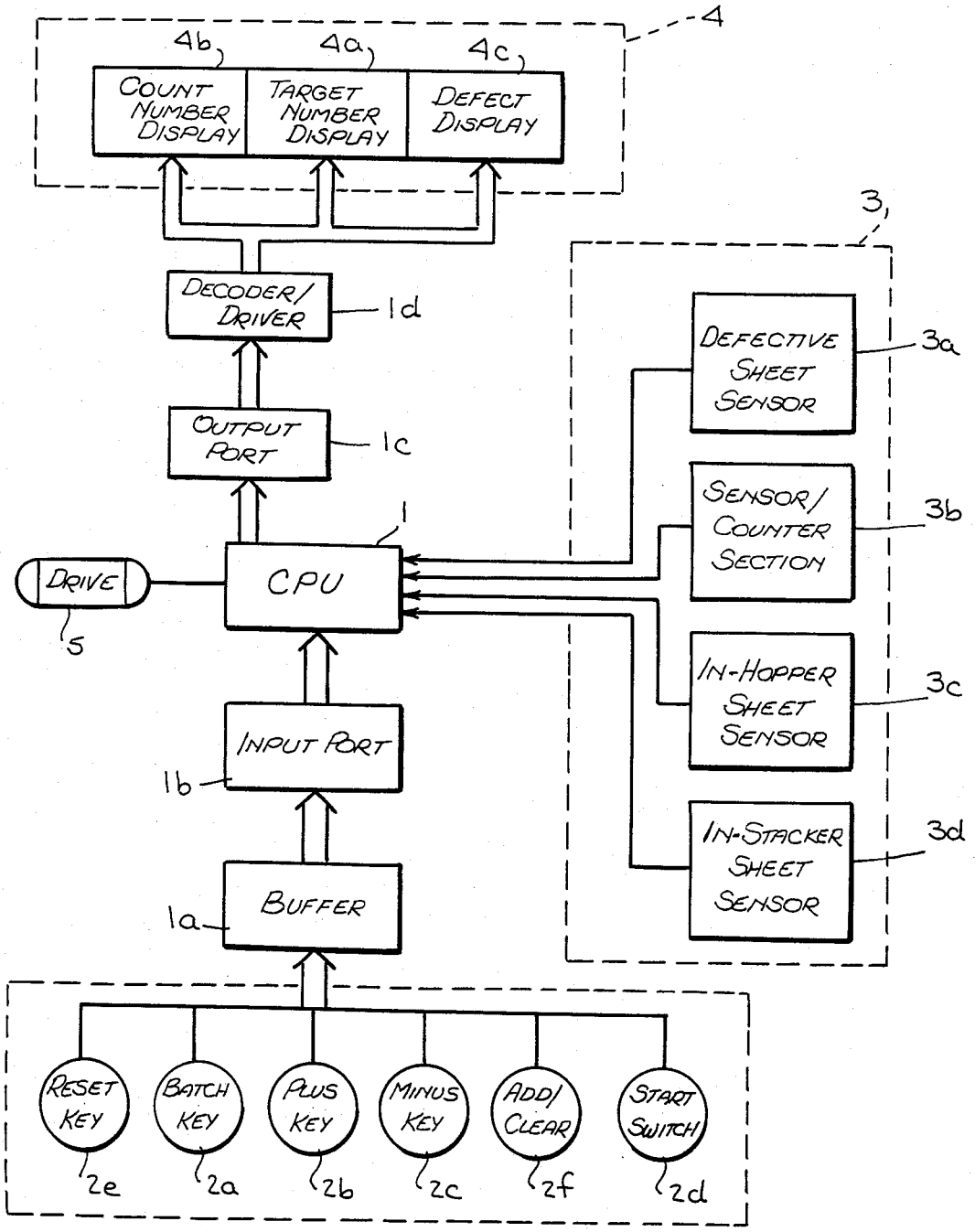
FIG. 1 is a block diagram schematically showing the apparatus according to the present invention.

In FIG. 1, there is illustrated schematically an operating circuit of the paper sheet counting device according to an embodiment of the present invention. Various signals from an operating part 2 and a sensor part 3 are inputted through a buffer 1*a* and an input port 1*b* to a central processing unit or CPU 1, where these signals undergo comparison or an arithmetic operation for controlling the operation of a driving part 5 which is designed to feed out the paper sheets for counting. Simultaneously, these signals are supplied to a display part 4 for display through an output port 1*c* and a decoder/driver circuit 1*d*.

The target number of sheets entered by keys 2*a*, 2*b* and 2*c* is transferred through CPU and displayed on a target number display part 4*a*. Then, upon acuation of a start switch 2*d*, the paper sheets placed in a hopper, not shown, are fed out one by one by the driving unit 5 to be stacked on a stacker, also not shown. Each paper sheet thus fed out is sensed by a sensor/counter 3*b* of the sensor unit 3, and the resulting sensor/counter signals are supplied to CPU 1, while the corresponding count number is displayed in a count number display part 4*b*. When the target number in the display part 4*a* is coincident with the count number in the display part 4*b*, the CPU 1 detects this state to deactivate the driving unit 5.

A defective sheet sensor part 3*a* operates to check the state of paper sheets being transferred to find out those defective sheets which may lead to counting errors. For example, when two or more superposed or consecutive sheets or halved sheets are detected, this state is displayed on a defect display part 4*c* while the operation of the driving unit 5 is halted.

Figure 2:
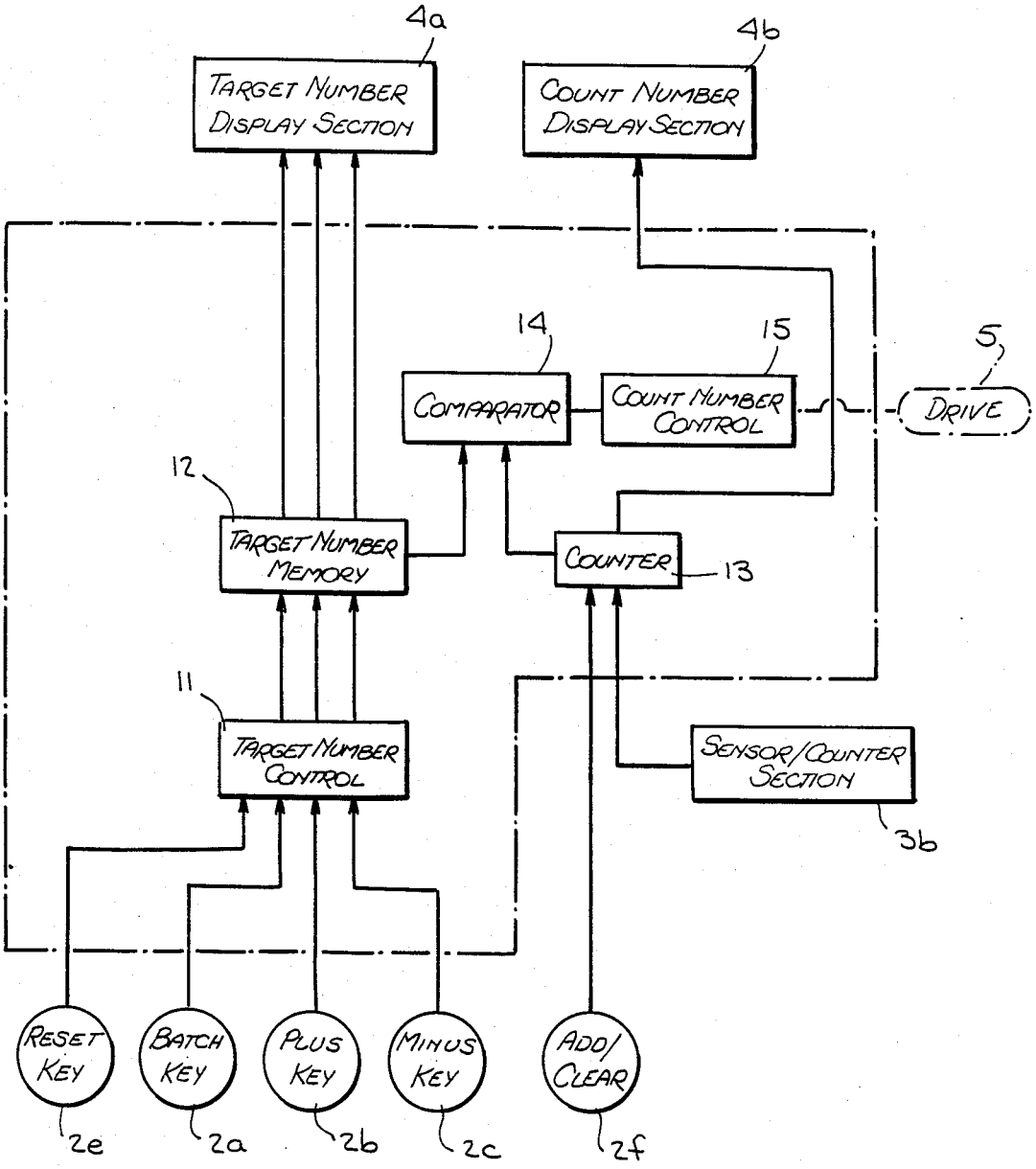
FIG. 2 is a block diagram showing the inside of the central processing unit.

The operating circuit in the CPU 1 of the counting apparatus is shown schematically in FIG. 2 in greater detail. Since the defective sheet sensor part 3*a* and the defective sheet display part may be similar to those shown in the said Japanese Laid-Open Patent Specification No. 58-6023, they are not shown in FIG. 2. In this figure, signals from a batch key 2*a*, a plus key 2*b* and a minus key 2*c* are supplied to a target number control unit 11 which then operates to output data stored in a target number memory 12 to a target number display 4*a* for display. Simultaneously, these data are supplied to a comparator 14. The count number signal from the sensor/counter 3*b* is supplied to a counter 13. The count number signal from the counter 13 is outputted to the count number display part 4*b* for display and to the comparator 14. Signals from an add/clear changeover switch 2*f* are also supplied to the counter 13 which then operates to sum the count numbers for respective batch operations when the switch 2*f* is leveled to add and to clear the count number display upon termination of the respective batch operations when the switch 2*f* is leveled to clear.

The comparator 14 compares the target number signal from the target number memory 12 to the count number from the counter 13, and outputs a coincidence signal to a count number control unit 15 when the two signals coincide with one another. The control part 15 outputs a stop signal to the driving unit 5.

Figure 3:
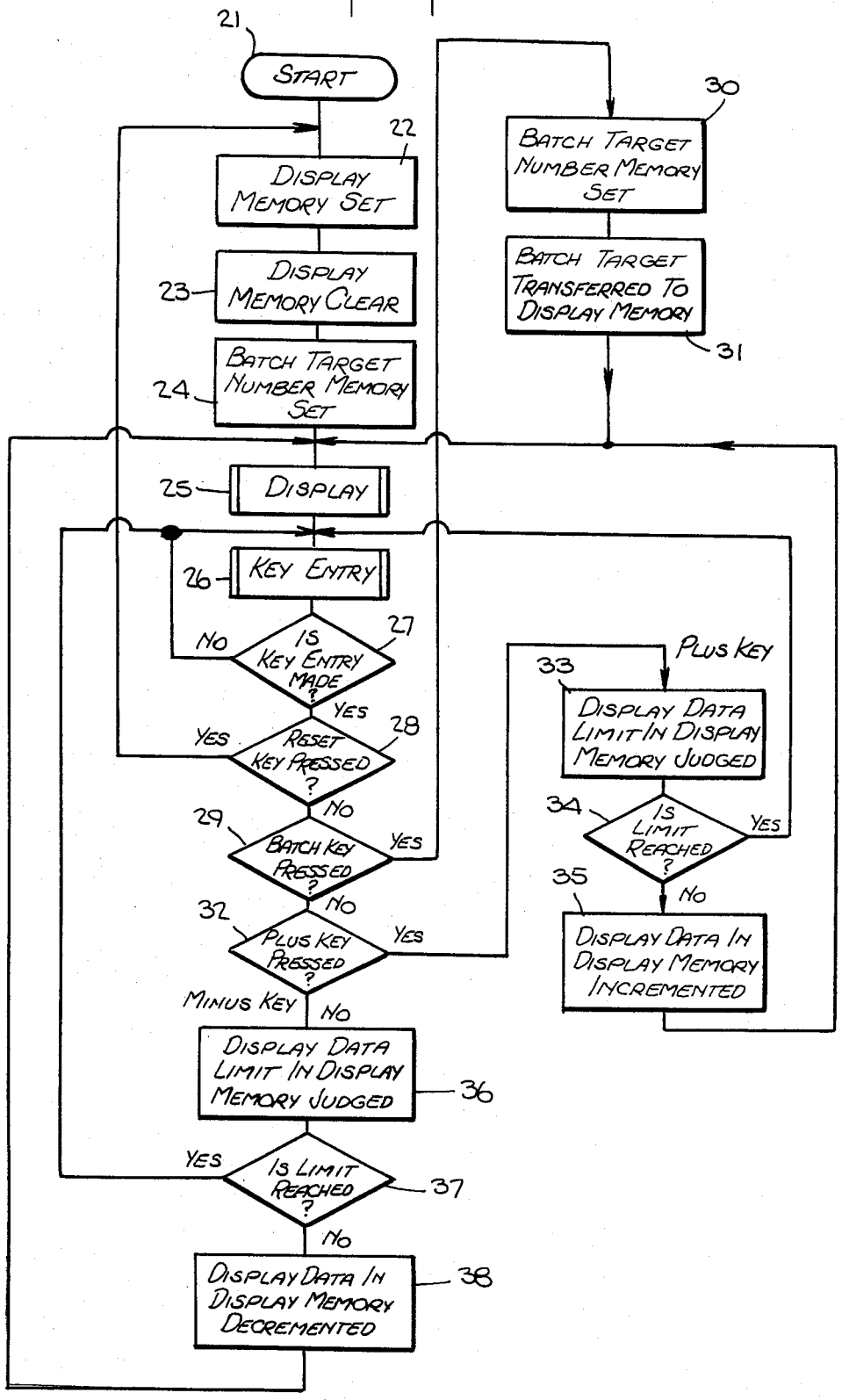
FIG. 3 is a flowchart for illustrating the operation of the unit shown in FIG. 2.

The operation of CPU for display of the number of paper sheets shown in FIG. 2 is described below by referring to a flow chart shown in FIG. 3. The operation is started upon connection to a power source (block 21). When the operation is started, a display memory in the target number memory 12 is reset to zero while it is activated for data storage (blocks 22, 23). A batch target number memory in the memory 12 is also activated for data storage (block 24). Fixed data for target numbers such as 100, 50, 20, 10 and infinity ($\infty$) are stored in this batch target number memory. In this initial state, zero is displayed in the target number display unit 4*a* (block 25). Next, a selected one of batch key 2*a*, plus key 2*b*, minus key 2*c* or reset key 2*c* is pressed (blocks 26 and 27). When the reset key 28 is pressed, the display in the display unit 4*a* is cleared ("yes" in block 28). When the batch key 2*a* is pressed (block 29), the fixed data 100, 50, 20, 10 and infinity ($\infty$) stored in the batch target number memory are transferred sequentially into the aforementioned display memory, and are displayed cyclically in the display part 4*a* (blocks 30, 31). When the manual pressure on the display memory 12 is released, the current one of the fixed data is stored in the display memory and displayed in the display part 4*a*.

When the plus key 2*b* is pressed subsequently, the number as set by the batch key 2*a* is incremented by one. When the manual pressure on the plus key is released, the incremented number is displayed (blocks 32, 33, 34, 35). When the minus key 2*c* is pressed, the displayed target number is decremented by one. When the manual pressure on the key is released, the decremented number is displayed ("no" in block 32). A certain limitation (for example, 100) is provided to the increment or decrement operations to be performed with the plus or minus keys and these operations are discontinued in the event that the key operations should cause this limit to be exceeded (blocks 34, 37).

In this manner, the desired target number of paper sheets is stored in the target number memory 12. This number is also supplied to the comparator 14 as mentioned hereinabove.

In the case of a continuous counting operation, an infinity mark $\infty$ is displayed by batch key 2*a* in the display part 4*a*. By this, the comparator 14 is disabled to check for coincidence between the signal from the counter 13 and the signal from the target number memory 12 so that the counting operation is continued until depletion of the paper sheets stored in the hopper for counting. The batch counting operation can be performed with the desired target number of the paper sheets displayed in the display part 4*a* by using the batch key and the plus or minus key.

In the above embodiment, start switch 2*d* is pressed for starting the counting. However, this start switch may be replaced by a manual/auto changeover switch so that the switch acts in the same manner as start switch 2*d* when set to manual, and the automatic counting operation may be started when the switch is set to auto. In the latter case, the automatic counting may be initiated by taking the AND of a signal from an in-hopper sheet sensor 3*c* indicating the presence of the paper sheets in the hopper, a signal from an in-stacker sheet sensor 3*d* indicating the absence of the paper sheets in the stacker and a signal indicating termination of target number entry and display operations.

The various operations described in the foregoing may be taken charge of by a microprocessor to provide a paper sheet counting apparatus which is extremely small in size and hence can be handled conveniently.

What is claimed is:

1. An apparatus for counting the number of paper sheets wherein a target number entered by an entry unit is stored in a target number memory and displayed in a target number display section, the paper sheet count number supplied from a sensor and counter section since the time of start of the counting operation is displayed in a count number display section and compared to said target number, and wherein the counting operation is discontinued in case of coincidence between said count number and the target number, characterized in that said entry section has a batch key, a plus key and a minus key, said target number memory has stored therein a predetermined number of fixed data that are displayed cyclically during the time said batch key is operated, the cyclical display is discontinued upon termination of the batch key operation and one of said fixed data prevailing at the time of termination of the batch key operation is entered in said target number memory, the fixed data thus entered in said target number memory is incremented or decremented by one each time said plus or minus key is operated, the incremented or decremented data prevailing when the plus or minus key is entered as said target number, and the target number thus entered is compared to the count number from said sensor and counter section.

2. The apparatus as claimed in claim 1, characterized in that said fixed data include an infinite number ($\infty$) and wherein a continuous counting operation is performed when the infinite number is entered in said target number memory as said fixed data.

* * * * *